US009528707B2

(12) United States Patent
Atemboski et al.

(10) Patent No.: US 9,528,707 B2
(45) Date of Patent: Dec. 27, 2016

(54) FIREPLACE ASSEMBLY WITH BIOMASS FUEL DELIVERY SYSTEM

(75) Inventors: Alan R. Atemboski, Renton, WA (US); Kurt W. F. Rumens, Snohomish, WA (US); Homer Lee, Vancouver (CA); William Ross Fotheringham, Everett, WA (US); Travis Gallion, Everett, WA (US)

(73) Assignee: Travis Industries, Inc., Mukilteo, WA (US)

( * ) Notice: Subject to any disclaimer, the term of this patent is extended or adjusted under 35 U.S.C. 154(b) by 0 days.

(21) Appl. No.: 13/595,974

(22) Filed: Aug. 27, 2012

(65) Prior Publication Data

US 2013/0160757 A1 Jun. 27, 2013

Related U.S. Application Data

(60) Provisional application No. 61/527,962, filed on Aug. 26, 2011.

(51) Int. Cl.

| | |
|---|---|
| ***F24B 1/199*** | (2006.01) |
| ***F24B 1/181*** | (2006.01) |
| ***F24B 13/04*** | (2006.01) |
| ***F23K 3/00*** | (2006.01) |
| ***F24B 1/02*** | (2006.01) |

(52) U.S. Cl.

CPC ..... *F24B 1/181* (2013.01); *F23K 3/00* (2013.01); *F24B 1/024* (2013.01); *F24B 1/199* (2013.01); *F24B 13/04* (2013.01)

(58) Field of Classification Search

CPC ..... B65G 65/4836; B65G 53/4625; B65G 53/4616; B65G 53/4633; B65G 53/10; B65G 69/0441; B65G 69/181;B65D 88/26; F27B 1/20; F27D 3/10; F27D 25/008; F27D 3/0033; F23K 3/16; F23K 3/18; F23B 1/38; F23B 3/18; F23B 50/12; F24B 1/024; B01F 15/0218; B28C 7/166

USPC 222/370, 636, 345, 346, 367, 557; 126/501; 406/120

See application file for complete search history.

(56) References Cited

U.S. PATENT DOCUMENTS

| | | | | | |
|---|---|---|---|---|---|
| 659,971 | A | * | 10/1900 | Hower | 126/68 |
| 3,093,270 | A | * | 6/1963 | Sarmento et al. | 222/360 |
| 4,427,297 | A | * | 1/1984 | Stastny | 366/19 |
| 4,599,015 | A | * | 7/1986 | Krambrock | 406/66 |
| 4,747,524 | A | * | 5/1988 | Krambrock | 222/636 |
| 5,014,682 | A | * | 5/1991 | Payson et al. | 126/501 |
| 5,133,266 | A | * | 7/1992 | Cullen | 110/233 |
| 5,137,010 | A | * | 8/1992 | Whitfield et al. | 126/173 |
| 5,137,012 | A | * | 8/1992 | Crossman et al. | 126/501 |

(Continued)

*Primary Examiner* — Jason Lau

(74) *Attorney, Agent, or Firm* — Perkins Coie LLP

(57) ABSTRACT

A biomass-burning fireplace assembly with a hopper and an outlet adjacent to the hopper outlet. A fuel metering assembly is adjacent to the hopper outlet and the barrier member. The fuel metering assembly has a fuel metering receptacle that receives the biomass fuel from the hopper. The fuel metering receptacle is moveable relative to the hopper between first and second positions on opposite sides of the barrier member. The barrier member is a physical barrier between the fuel metering receptacle and the hopper outlet when in the second position. A fuel feed assembly receives fuel from the fuel metering receptacle when is in the second position. The fuel feed assembly moves the fuel onto a burn platform assembly coupled to the firebox adjacent to the fuel inlet opening.

23 Claims, 16 Drawing Sheets

(56) References Cited

U.S. PATENT DOCUMENTS

| | | | | |
|---|---|---|---|---|
| 5,151,000 | A * | 9/1992 | Geraghty et al. | 414/187 |
| 5,183,028 | A * | 2/1993 | Traeger et al. | 126/73 |
| 5,873,356 | A * | 2/1999 | Vossler et al. | 126/110 E |
| 5,983,885 | A * | 11/1999 | Jarvi | 126/73 |
| 7,318,431 | B1 * | 1/2008 | Holtan et al. | 126/7 |
| 2003/0226561 | A1 * | 12/2003 | Darbonne, Sr. | 126/501 |
| 2008/0035675 | A1 * | 2/2008 | Norman | 222/181.3 |
| 2008/0160470 | A1 * | 7/2008 | Holtan et al. | 431/331 |
| 2009/0038603 | A1 * | 2/2009 | Hepper et al. | 126/73 |
| 2009/0107329 | A1 * | 4/2009 | Lee | 95/22 |
| 2009/0272302 | A1 * | 11/2009 | Nelson et al. | 110/258 |
| 2009/0293860 | A1 * | 12/2009 | Carlson | 126/501 |

* cited by examiner

FIREPLACE ASSEMBLY WITH BIOMASS FUEL DELIVERY SYSTEM

This non-provisional patent application hereby claims priority to U.S. Provisional Patent Application No. 61/527,962, titled Fireplace Assembly With Biomass Fuel Delivery System, filed Aug. 26, 2011, which is incorporated herein in its entirety by reference thereto.

TECHNICAL FIELD

The present invention is directed to biomass burning fireplace assemblies, and more particularly to such fireplace assemblies with a biomass fuel delivery system and related methods.

BACKGROUND

Conventional pellet-burning stoves and fireplace assemblies direct the wood pellets from a hopper 14 to a burn pot for combustion. There is a need for improvements in, for example, better fuel delivery, burn rate control, fuel selection, efficiency, and/or other operational functions.

SUMMARY

The present invention provides a biomass-burning fireplace assembly (including fireplaces, stoves, and inserts) and related methods that overcome drawbacks experienced in the prior art and that provide additional benefits. The present invention is also directed to a fuel delivery system for a biomass-burning fireplace assembly. At least one aspect of the disclosure is directed to a biomass-burning fireplace assembly comprising a firebox having a fuel inlet opening, and a hopper configured to contain a biomass fuel. The hopper has a hopper inlet and a hopper outlet. A barrier member is adjacent to the hopper outlet, and a fuel metering assembly is adjacent to the hopper outlet. The fuel metering assembly has a fuel metering receptacle that receives the biomass fuel from the hopper, and the fuel metering receptacle is moveable relative to the hopper outlet between first and second positions. The fuel metering receptacle in the first position is on a first side of the barrier member and arranged to receive the biomass fuel from the hopper outlet. The fuel metering receptacle in the second position is on second side of the barrier member and out of alignment with the hopper outlet. The barrier member is a physical barrier between the fuel metering receptacle and the hopper outlet. A fuel feed assembly having a feed inlet positioned is in alignment with the fuel metering receptacle when the fuel metering receptacle is in the second position to receive the biomass fuel from the fuel metering assembly, wherein the feed inlet is blocked from the hopper outlet by at least a portion of the barrier member to avoid a fire path to the hopper. The fuel feed assembly has a fuel feed outlet in communication with the fuel inlet opening in the fire box and having a fuel advancing member disposed between the fuel feed inlet and fuel feed outlet and is configured to move the biomass fuel out the fuel feed outlet and through the fuel feed inlet of the firebox. A burn platform assembly is coupled to the firebox and positioned adjacent to the fuel inlet opening. The burn platform has a support surface that receives the biomass fuel received from the fuel feed assembly.

The fuel metering assembly can include a metering disk rotatably disposed relative to the hopper outlet, wherein the fuel metering disk has the fuel metering receptacle disposed therein, and wherein rotation of the metering disk moves the fuel metering receptacle between the first and second positions. The fuel metering assembly can include a drive motor operatively coupled to the metering disk and configured to rotate the fuel metering disk. The fuel metering receptacle can include first and second metering receptacles each being moveable between the first and second positions. The first fuel metering receptacle can be in the first position when the second fuel metering receptacle is in the second position. The fuel metering assembly can include a drive motor coupled to the metering member that has the fuel metering receptacle therein, and the drive motor can be configured to move the metering member relative to the hopper outlet. The barrier member can engage the metering member when the metering member moves the fuel metering receptacle between the first and second positions. The barrier member can rotate about a central axis when the metering member moves the fuel metering receptacle between the first and second positions. The fuel feed assembly can include a housing, and the fuel advancing member can be an auger member rotatable disposed in the housing, wherein rotation of the auger member advances the biomass fuel from the fuel feed inlet to the fuel feed outlet.

In at least another aspect of the present disclosure, a fireplace assembly has a housing, a firebox having a fuel inlet opening, and a fuel hopper configured to contain a solid fuel therein. The hopper has a hopper outlet adjacent to the fuel inlet opening. A fuel metering assembly is adjacent to the hopper outlet, and the fuel metering assembly has a fuel metering receptacle configured to receive the solid fuel from the hopper. The fuel metering receptacle is moveable relative to the hopper outlet between first and second positions. The fuel metering receptacle in the first position is arranged to receive the solid fuel from the hopper outlet. The fuel metering receptacle in the second position is out of alignment with the hopper outlet and out of communication with the hopper outlet to prevent a potential fire path to the hopper. A fuel feed assembly has a feed inlet positioned in direct communication with the fuel metering receptacle in the second position. The fuel feed assembly has a fuel feed outlet in communication with the fuel inlet opening in the fire box and has a fuel advancing member configured to move the solid fuel out the fuel feed outlet and through the fuel feed inlet of the firebox. A burn platform assembly is coupled to the firebox and positioned adjacent to the fuel inlet opening. The burn platform has a support surface that receives the solid fuel received from the fuel feed assembly for burning of the solid fuel in the fire box while on the support portion.

DETAILED DESCRIPTION

The present disclosure describes a biomass-burning fireplace assembly 10 (including fireplaces, stoves, and inserts), a fuel delivery system 12 for a biomass-burning fireplace assembly 10, and related methods in accordance with certain embodiments of the present invention. Several specific details of the invention are set forth in the following description and the Figures to provide a thorough understanding of certain embodiments of the invention. One skilled in the art, however, will understand that the present invention may have additional embodiments, and that other embodiments of the invention may be practiced without several of the specific features described below.

Figure 1:
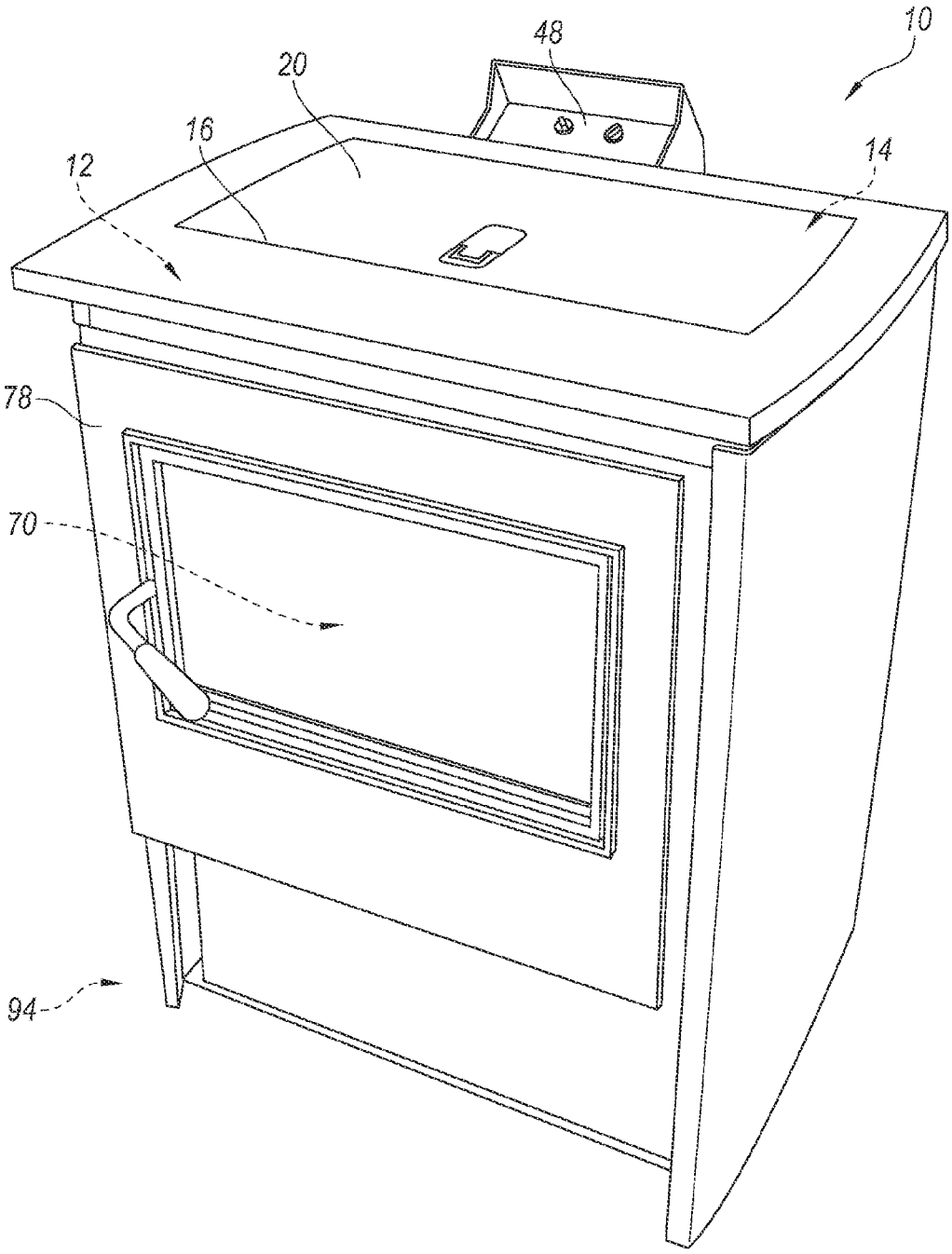
FIG. 1 is an isometric view of a fireplace assembly with a fuel delivery system in accordance with an embodiment of the present invention.
Figure 2:
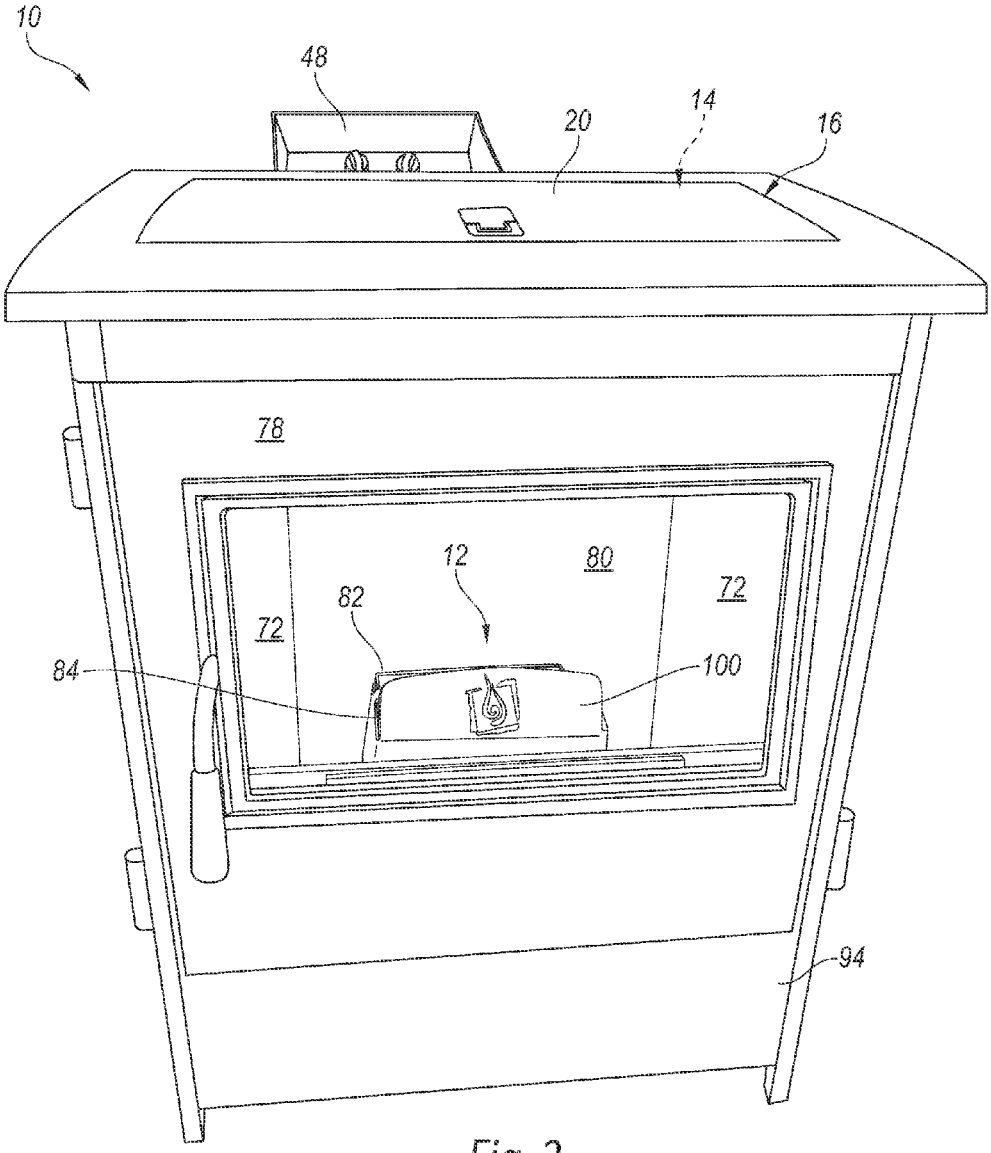
FIG. 2 is an enlarged isometric view of a front side of the fireplace assembly of FIG. 1.
Figure 3:
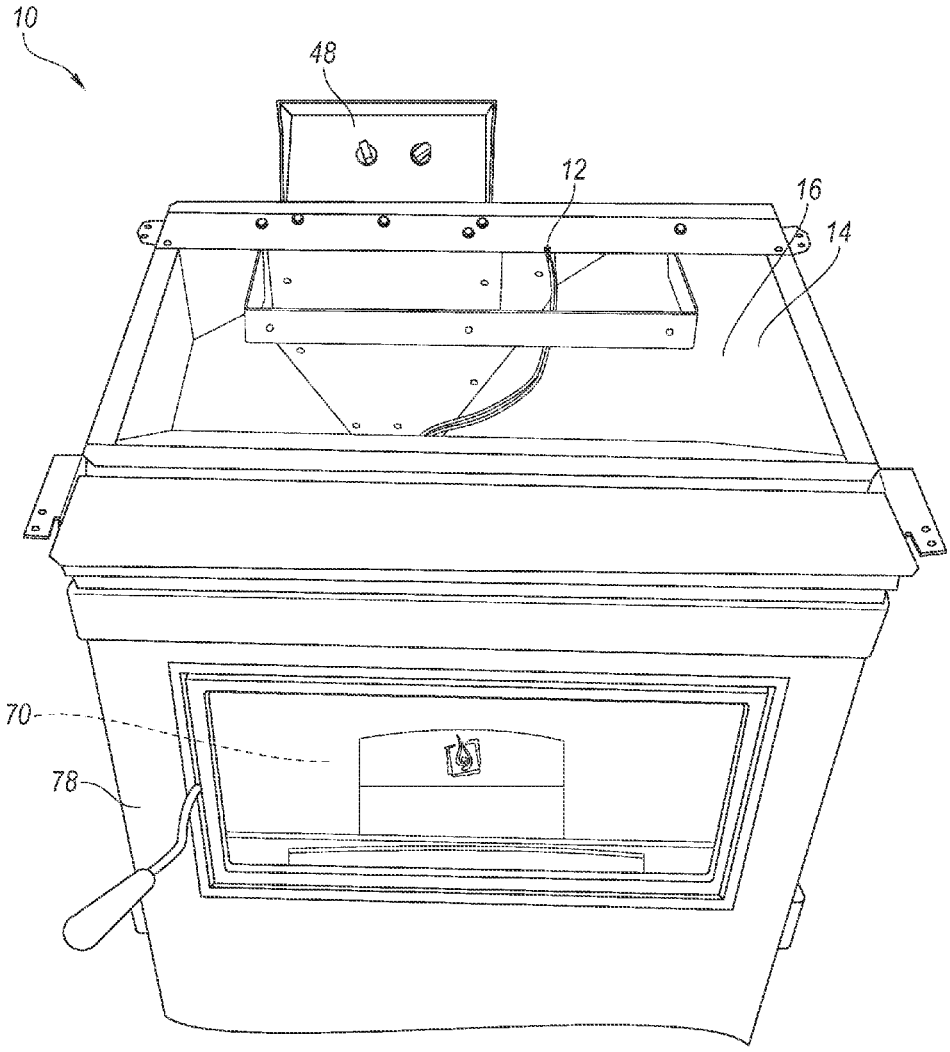
FIG. 3 is an enlarged top isometric view of the fireplace assembly of FIG. 1 with a top plate removed to show a hopper assembly.
Figure 4:
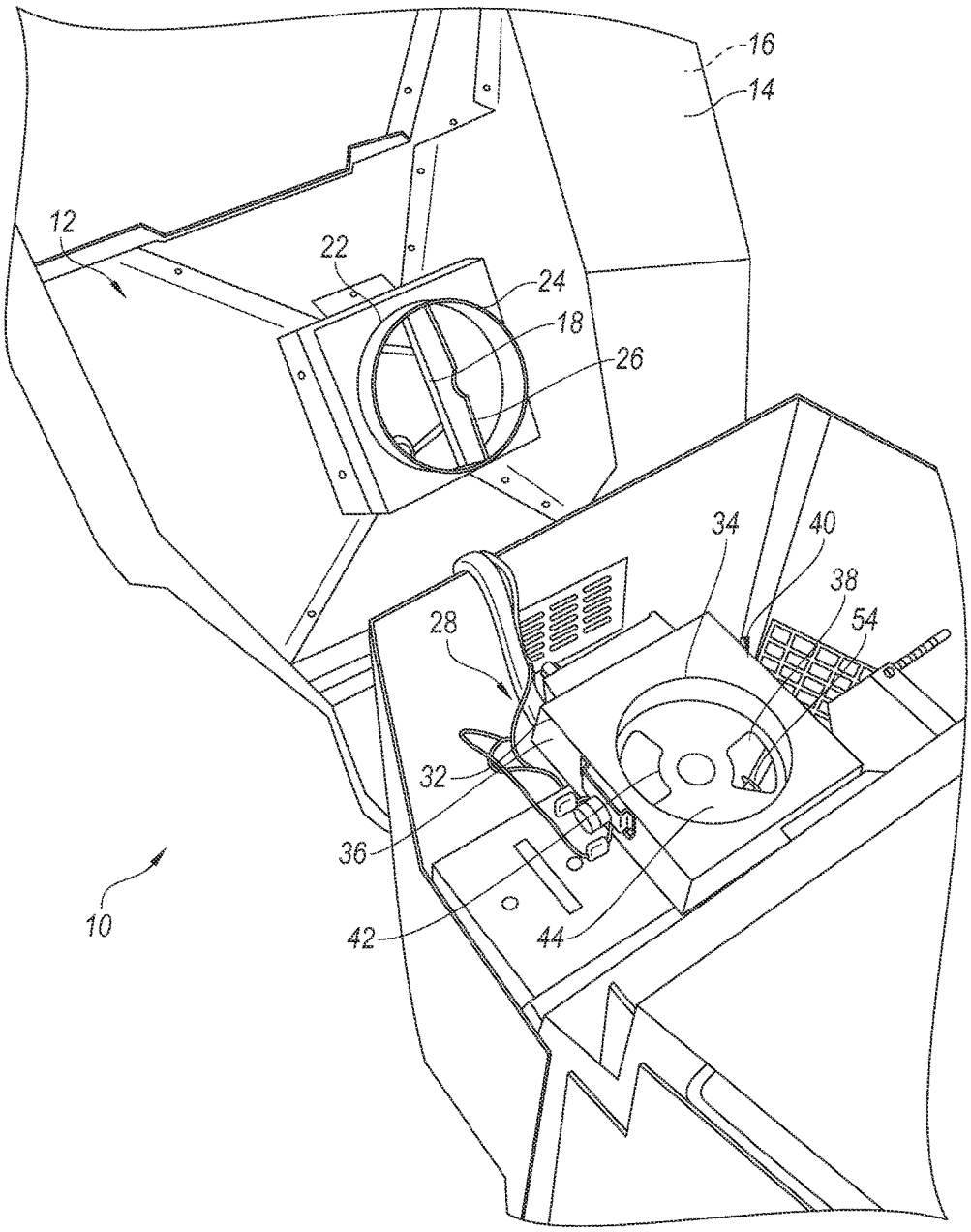
FIG. 4 is an enlarged isometric view of the fireplace assembly of FIG. 3 with the hopper assembly removed to show a fuel metering assembly.
Figure 5:
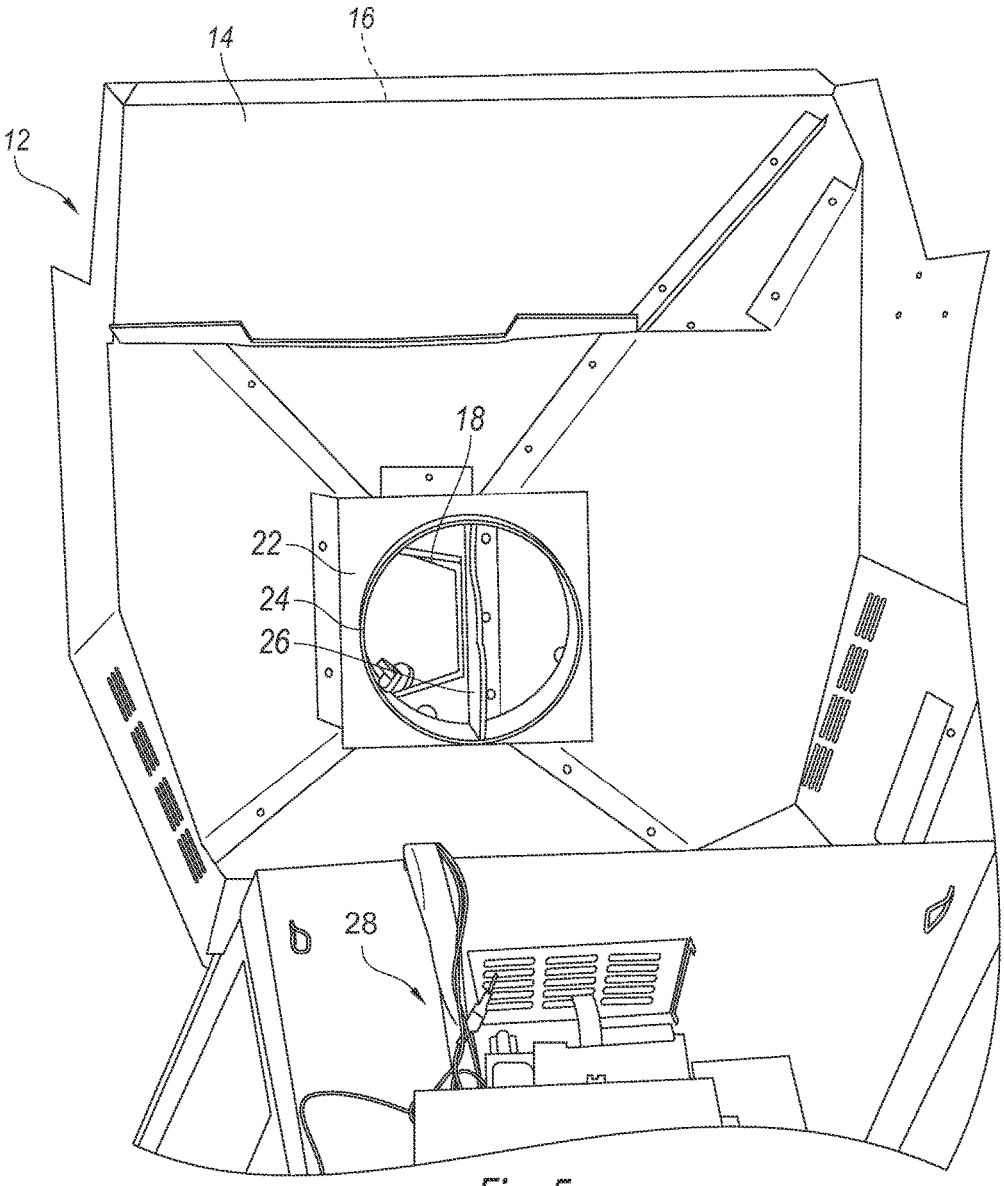
FIG. 5 is an enlarged bottom view of the hopper assembly of FIG. 4.
Figure 6:
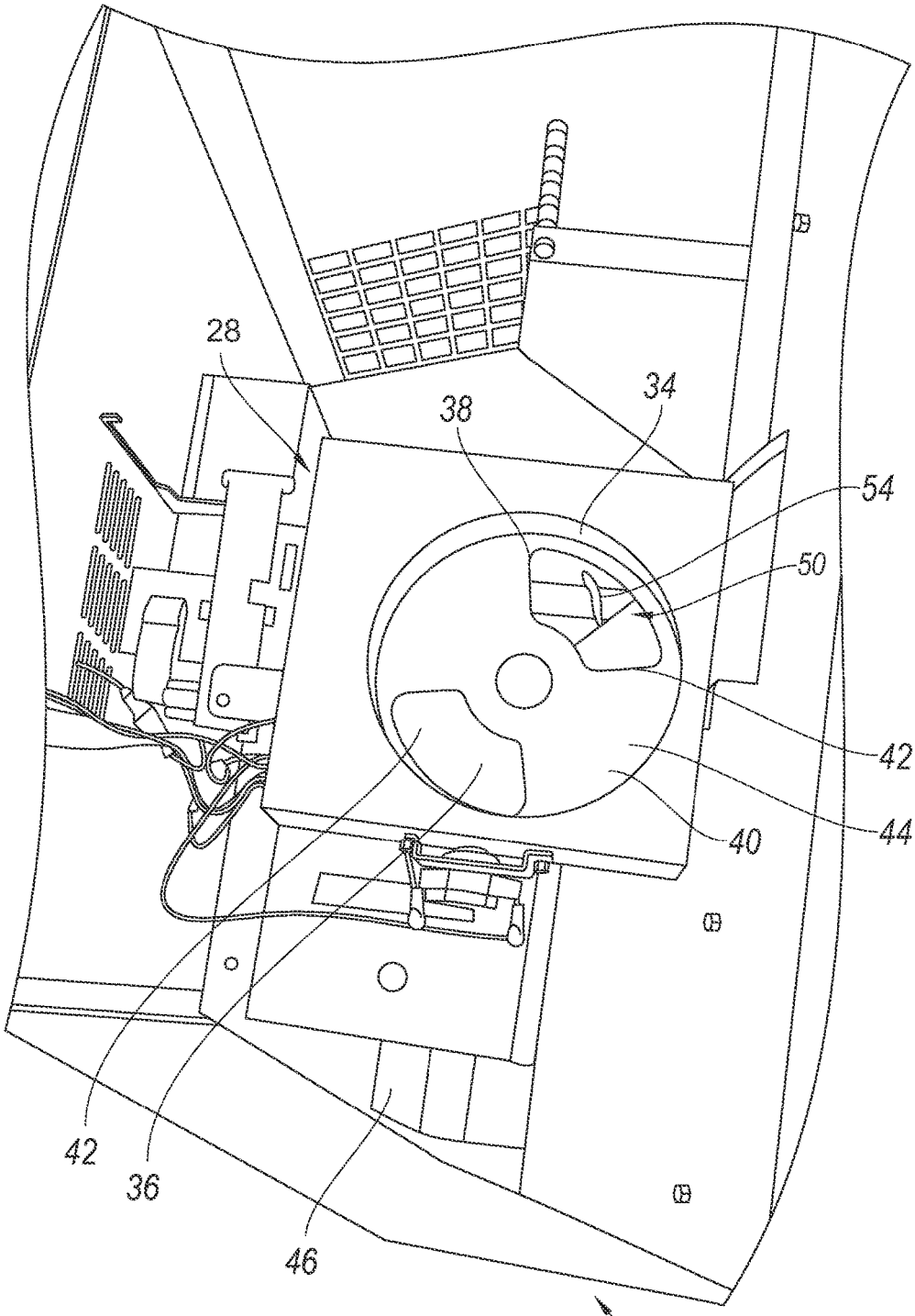
FIG. 6 is an enlarged top view of the fuel metering system of FIG. 4.
Figure 7:
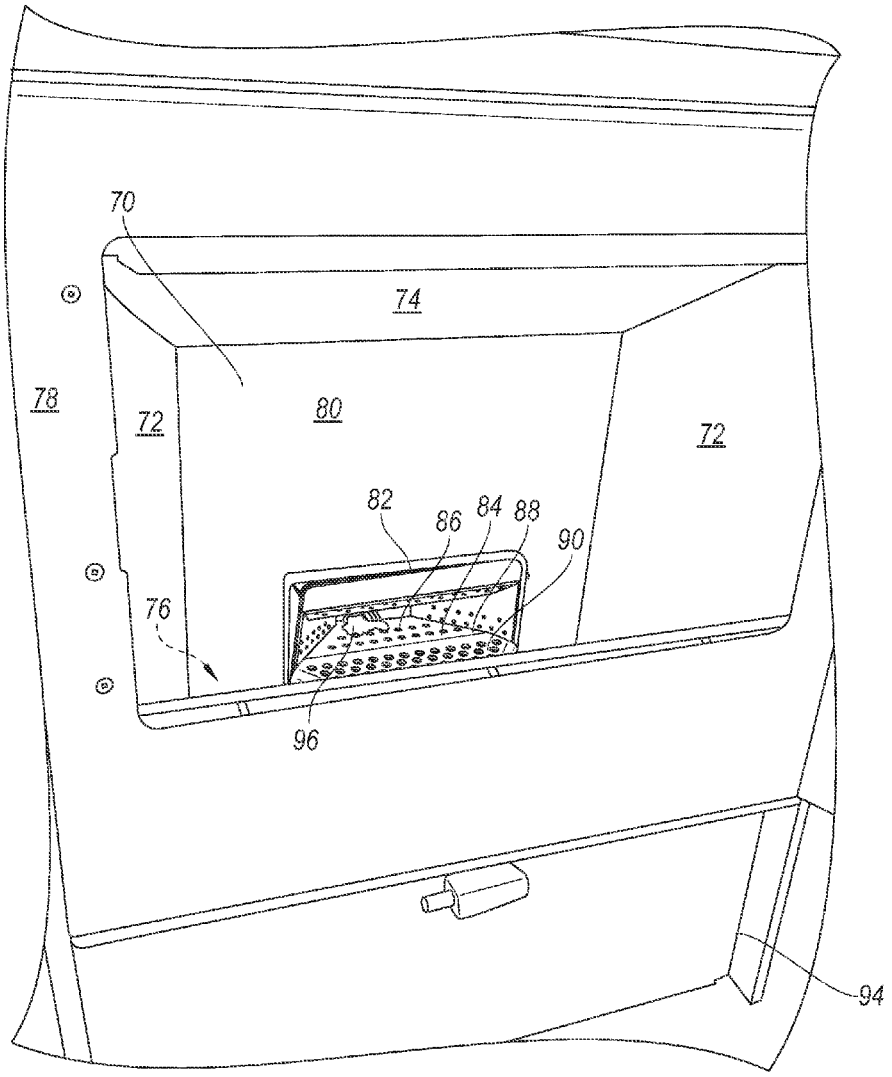
FIG. 7 is an enlarged front view of the fireplace assembly of FIG. 2 showing a portion of the fuel metering system in a fire box of the fireplace assembly.
Figure 8:
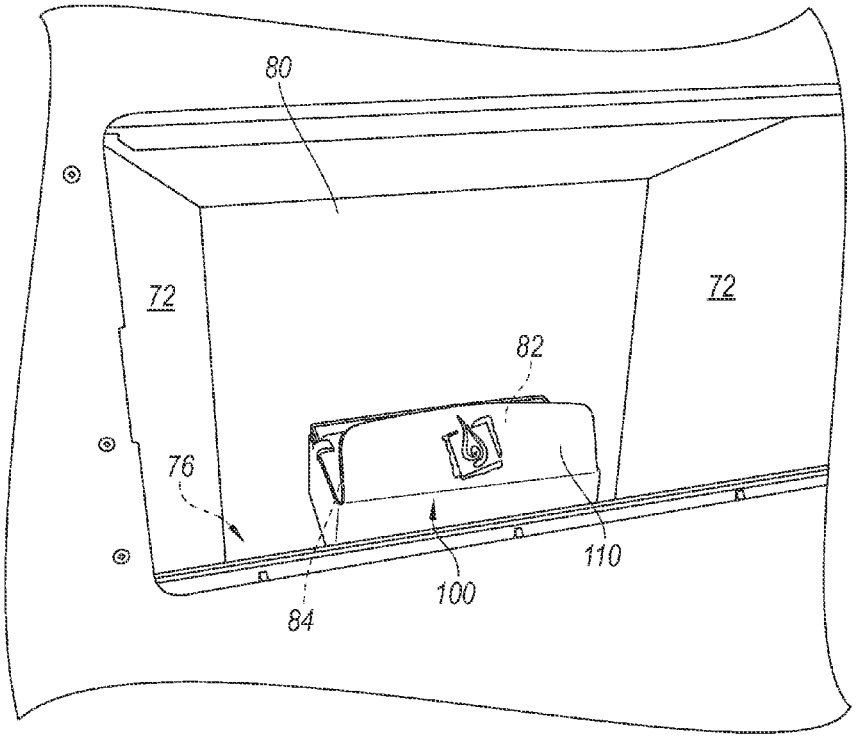
FIG. 8 is an enlarged front isometric view of a portion of the fuel metering assembly in the fire box of the fireplace assembly of FIG. 7.
Figure 9:
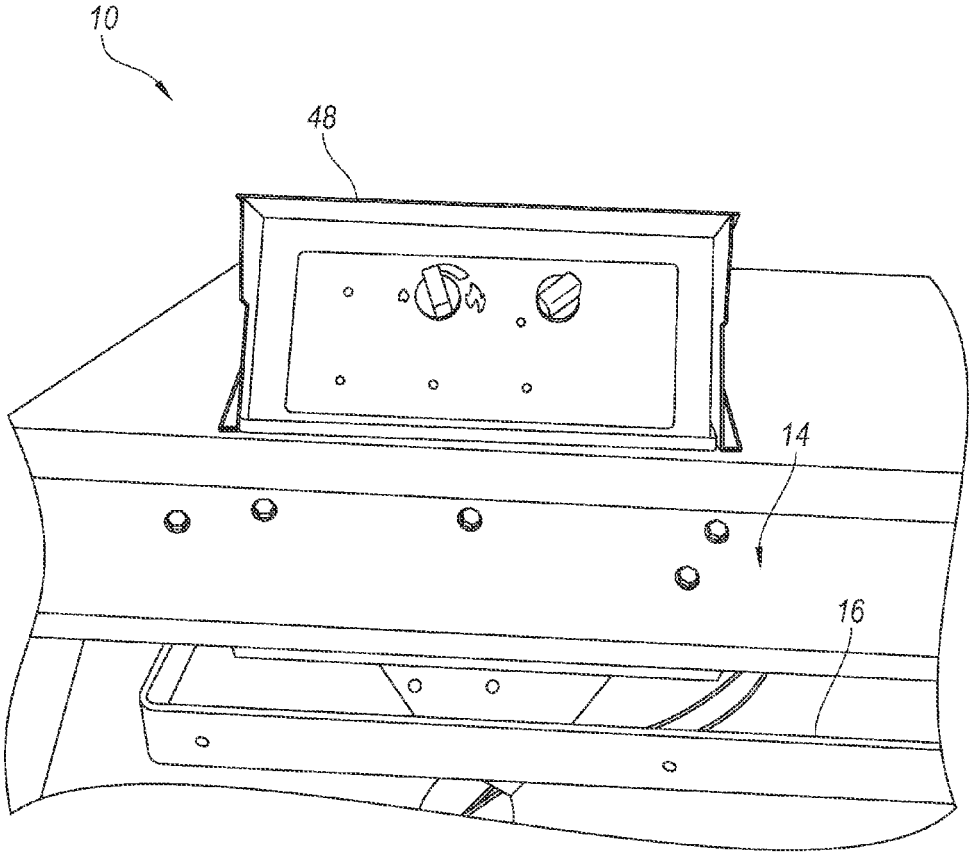
FIG. 9 is an enlarged front isometric view of the fireplace assembly with a fuel delivery assembly of FIG. 1, with a control system shown in a raised position.
Figure 10:
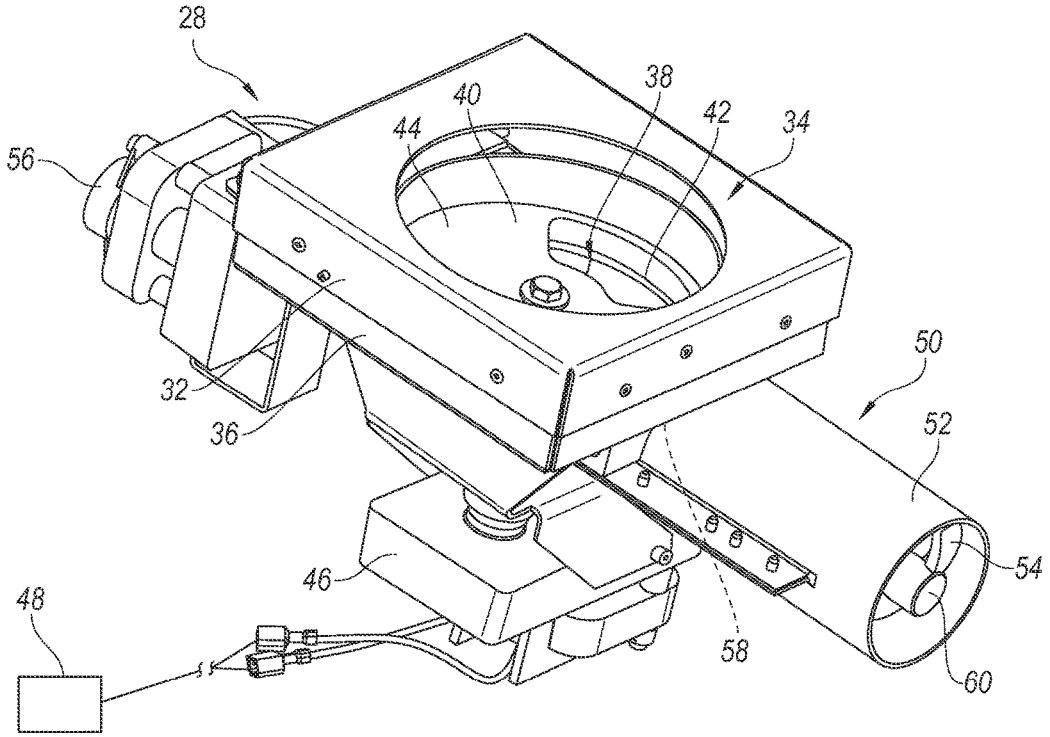
FIG. 10 is an isometric view of the fuel metering assembly of FIG. 6 shows removed from the fireplace assembly.
Figure 11:
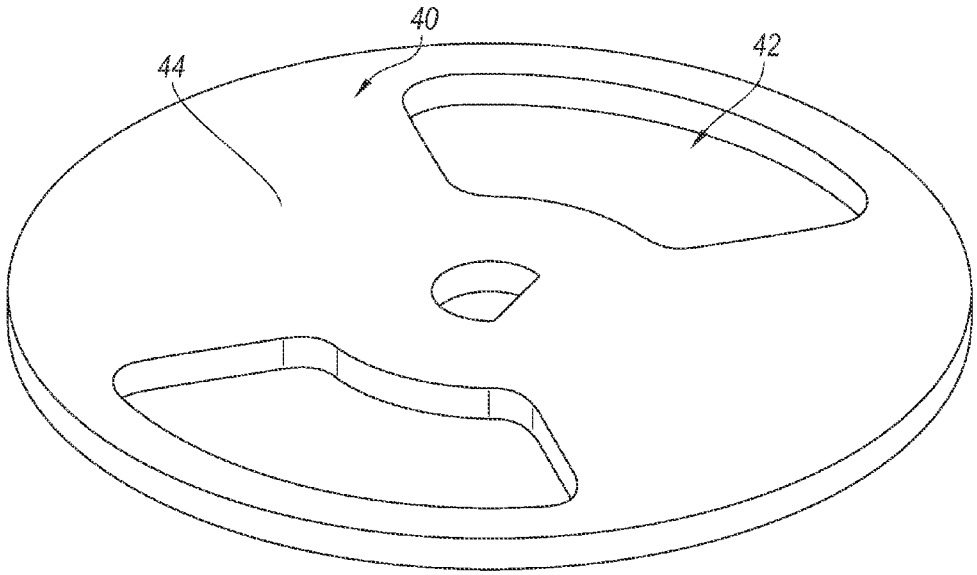
FIG. 11 is an enlarged isometric view of a fuel metering disc of the fuel metering assembly of FIG. 10.
Figure 12:
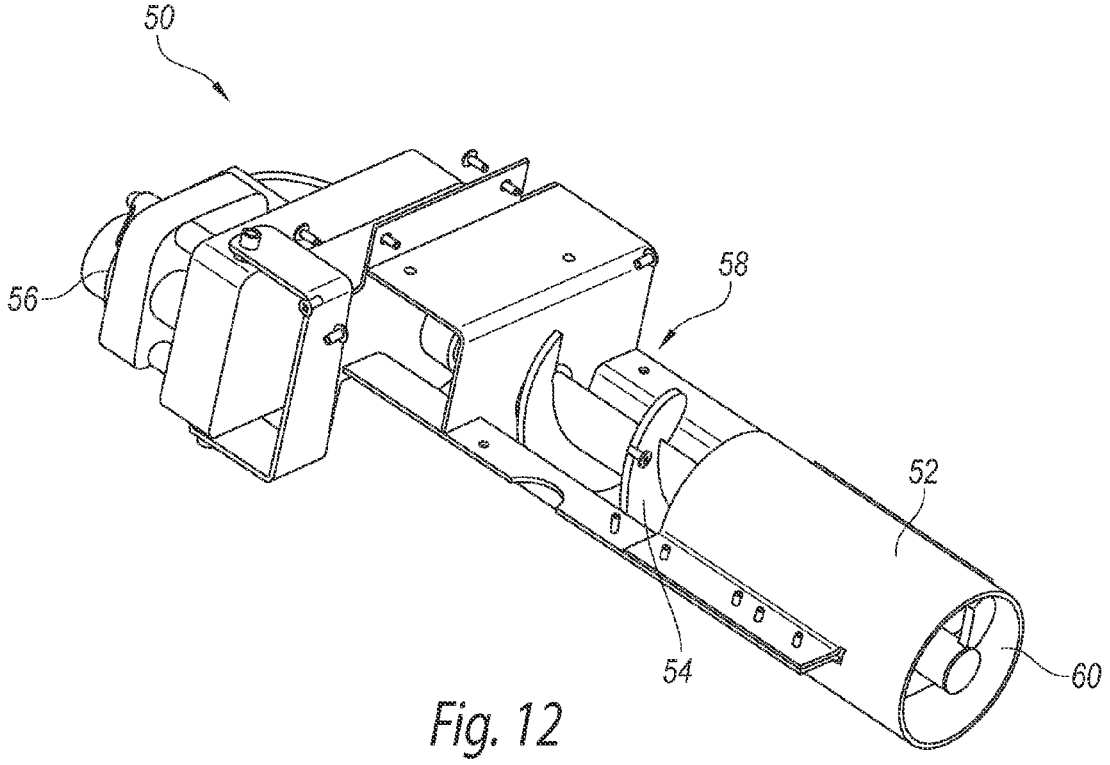
FIG. 12 is an enlarged isometric view of a feed auger assembly of the fuel metering assembly of FIG. 10.
Figure 13:
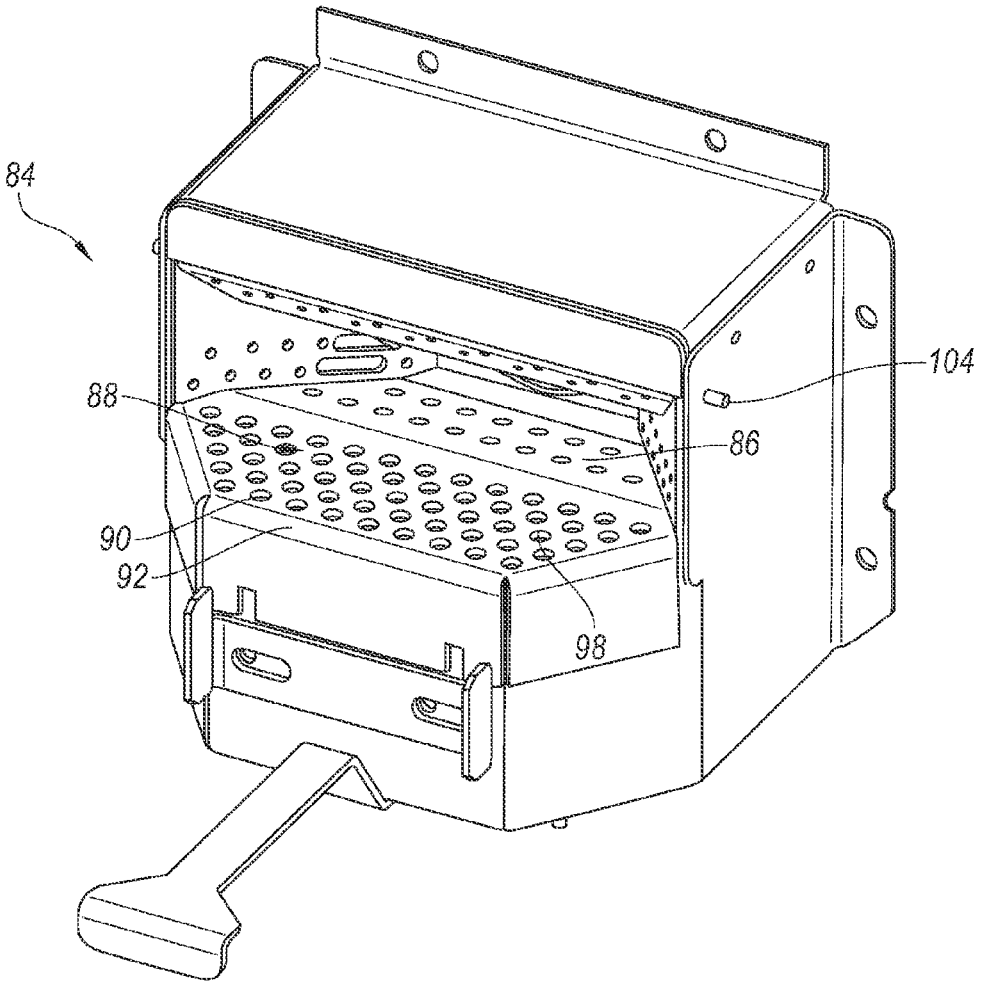
FIG. 13 is an enlarged front isometric view of a burning platform assembly shown removed from the fuel metering assembly of FIG. 10 and shown with a deflector removed.
Figure 14:
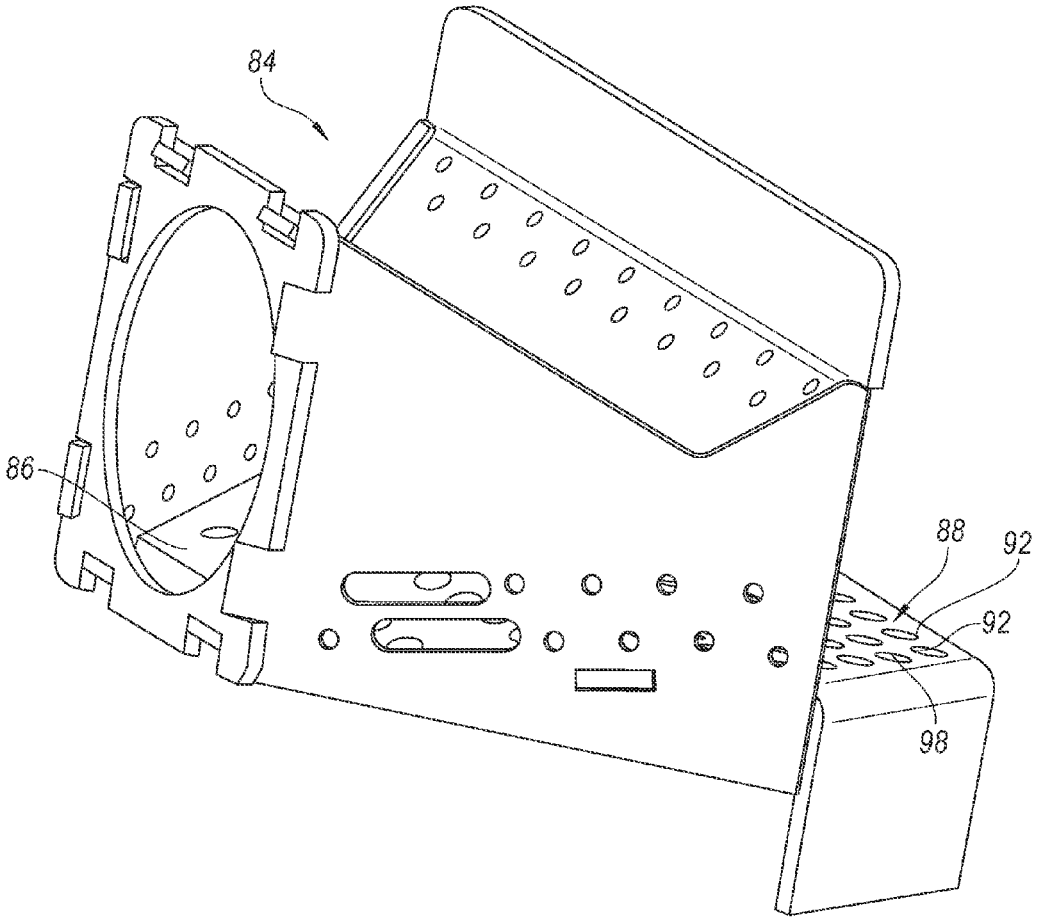
FIG. 14 is an enlarged rear isometric view of the burn platform assembly of FIG. 13.
Figure 15:
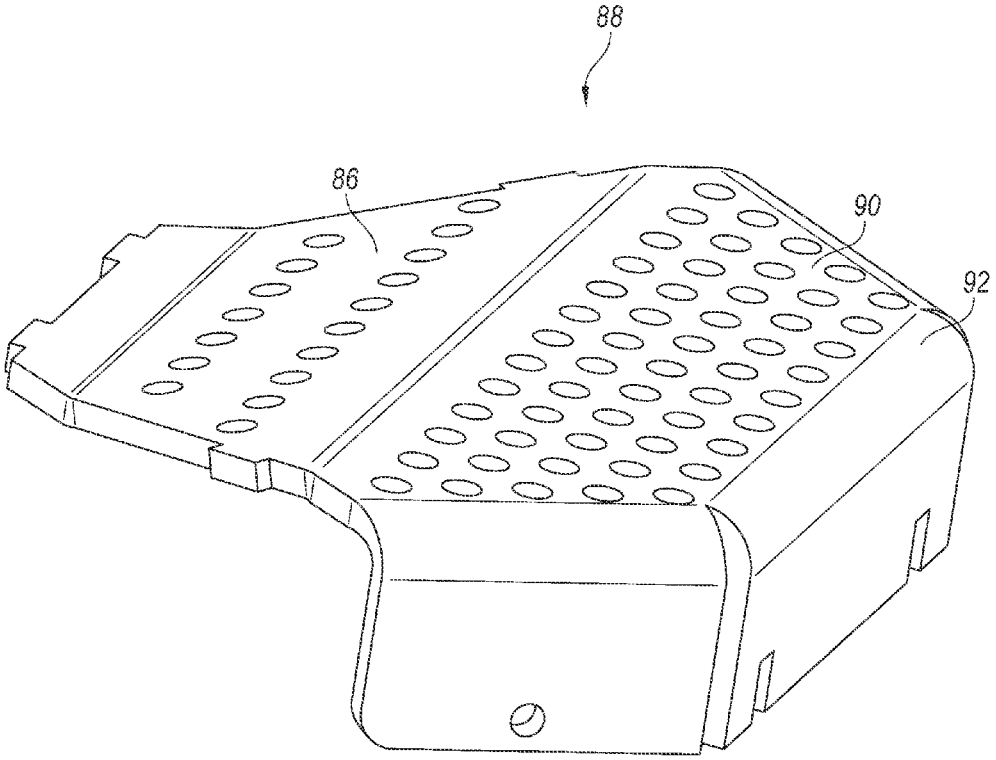
FIG. 15 is an enlarged front isometric view of the burn platform assembly of FIG. 13.
Figure 16:
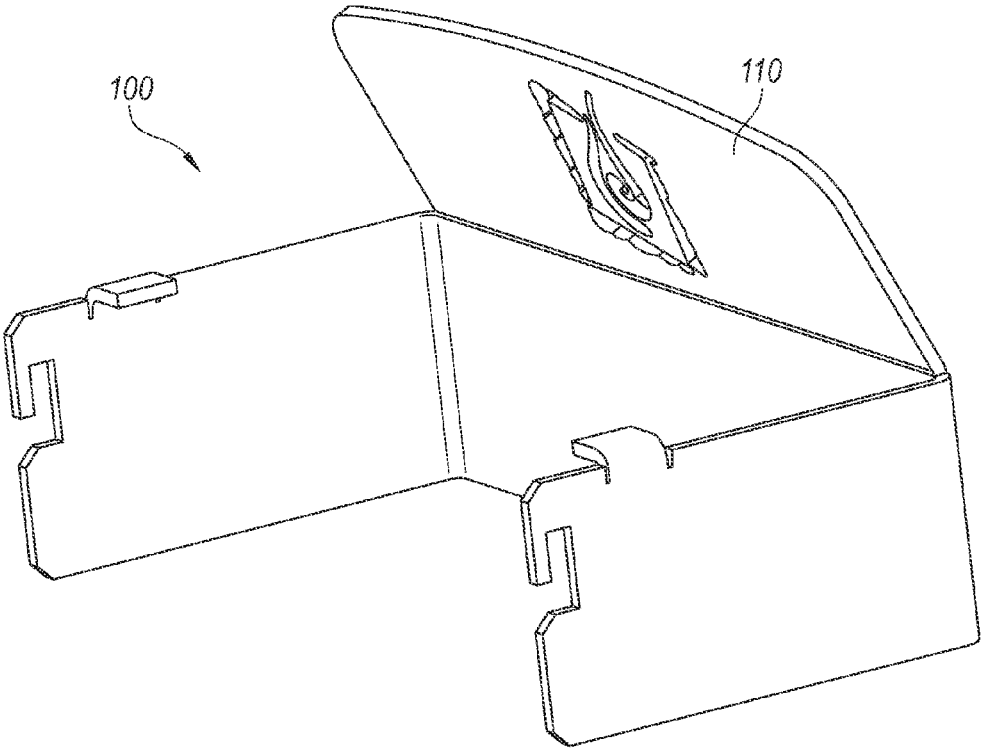
FIG. 16 is an enlarged isometric view of the deflector shown removed from the burn platform assembly of FIG. 13

FIGS. 1-3 are isometric views of a biomass-burning fireplace assembly 10 in accordance with at least one embodiment includes fuel hopper 14 with an inlet 16 and outlet 18. The hopper 14 is configured to contain a biomass fuel, such as wood pellets, wood chips, fruit pits, corn, other burnable biomass fuels, and combinations thereof), which will be efficiently burned in the fireplace assembly 10, as discussed in greater detail below. The hopper 14 has an openable cover 20 on the hopper 14 to cover the inlet 16 and to block material from inadvertently getting into the hopper 14.

The outlet 18 of the hopper 14 is an aperture sized to allow the biomass fuel exit the hopper 14 under the force of gravity. A guide 22 is attached to the bottom of the hopper 14 around the outlet aperture. The guide 22 has a substantially cylindrical bottom portion 24 and the outlet aperture is positioned above approximately one-half of the guide's circular cross section. The guide 22 has a wiper blade 26 formed by a blade seal 26 extending across the diameter of the cylindrical portion, such that the blade extends away from the hopper 14 and is generally adjacent to the hopper outlet aperture. Accordingly, the blade seal 26 divides the guide's bottom portion 24 in half, and fuel exiting the hopper 14 through the outlet 18 will pass through the guide 22 on only one side of the blade seal 26.

A fuel metering assembly 28 is positioned below the hopper outlet 18 and adjacent to the blade seal 26. The fuel metering assembly 28 includes a housing 32 with a cylindrical opening 34 shaped and sized to receive the cylindrical portion of the guide 22 in a close tolerance male/female fit. The fuel metering assembly 28 has a stationary base structure 36 with a fuel receiving opening 38 therein in alignment with the cylindrical opening 34 of the housing 32, but the fuel receiving opening 38 is axially off set from the hopper's outlet aperture. Accordingly, when the fuel exits the hopper outlet 18, the fuel will not fall via gravity directly into the fuel receiving opening 38. In the illustrated embodiment, the hopper's outlet aperture and the cylindrical opening 34 of the housing 32 are axially offset on opposite sides of the blade seal 26.

The fuel metering assembly 28 includes a fuel metering disc 40 rotatably attached to the housing 32 immediately adjacent to the base structure 36. The fuel metering disc 40 has a thickness and at least one through hole that defines a fuel metering receptacle 42 shape and sized to contain a predetermined volume of biomass fuel. In the illustrated embodiment, the fuel metering disc 40 has two through holes that define two fuel metering receptacles 42 on opposing sides of the fuel metering disc 40. The blade seal 26 on the guide 22 is sized to engage the top surface 44 of the fuel metering disc 40 across its full diameter.

The metering disc 40 is connected to a drive motor 46, which is coupled to the control system 48. The control system 48 controls activation and operation of the drive motor 46 so as to control the timing and rate of rotation of the fuel metering disc 40, thereby controlling the fuel feed rate from the hopper 14 through the fuel metering assembly 28 to the feed auger system (discussed below).

In operation, the control system 48 and the drive motor 46 activate rotation of the fuel metering disc 40 relative to the housing 32 and the hopper 14. The fuel metering disc 40 is rotated in a selected direction, such as clockwise, to a filling position wherein one of the fuel measuring receptacles 42 is partially or fully aligned with the hopper's outlet aperture. As the fuel metering disc 40 rotates, the blade seal 26 on the guide 22 remains substantially stationary, such that top surface 44 of the metering disc 40 is effectively swept by the blade seal 26. When the fuel measuring receptacle 42 is aligned below the hopper's outlet 18, the fuel measuring receptacle 42 is positioned over a flat portion of the base structure 36 parallel with the metering disc 40 and spaced apart from the fuel receiving opening 38. Accordingly, the flat portion of the base structure 36 defines a bottom of the metering receptacle 42. In this position, a selected volume of the biomass fuel drops via gravity from the hopper outlet 18 into the metering receptacle 42.

The drive motor 46, upon activation, rotates the metering disc 40 relative to the base structure 36 and the hopper 14, thereby causing the filled metering receptacle 42 to move out of axial alignment with the hopper outlet 18. As the filled metering receptacle 42 is moved out of alignment with the hopper alignment, the metering disc 40 blocks additional biomass fuel from exiting the hopper 14 until the disc is rotated enough to bring the other metering receptacle 42 into alignment with the hopper outlet 18. As the metering disc 40 rotates, the filled metering receptacle 42 passes under the blade seal 26, and the blade seal 26 prevents additional biomass fuel (except for what is in the metering receptacle 42) from getting past the blade seal 26. This insures that only a predetermined amount of fuel (at a predetermined rate) will move away from the hopper outlet 18, under the blade seal 26 and toward the fuel receiving opening 38 in the base structure 36.

As the drive motor 46 continues to rotate the metering disc 40, the full metering receptacle 42 will move into an emptying position in alignment with the fuel receiving opening 38 in the base structure 36 (which is on the opposite side of the blade seal 26 relative to the hopper outlet 18). In this emptying position, the fuel drops via gravity from the metering receptacle 42 through the fuel receiving opening 38 until the metering receptacle 42 is fully emptied. In the illustrated embodiment, when one metering receptacle 42 is in the filling position, the other metering receptacle 42 is in the emptying position. While the illustrated embodiment has two metering receptacles 42, other embodiments can have a greater or fewer number of metering receptacles.

The base structure 36 is connected to a feed auger assembly 50 positioned and configured to receive the fuel as the fuel empties from the metering receptacle 42 through the fuel receiving opening 38. The feed auger assembly 50 includes a cylindrical housing 52 that contains a rotatable feed auger 54 coupled to an auger drive motor 56. The auger drive motor 56 is operatively coupled to the control system 48. In the illustrated embodiment, the top of the cylindrical housing 52 has an opening aligned with the fuel receiving opening 38 and positioned adjacent to a proximal portion of the feed auger 54. Accordingly, when the biomass fuel falls from the fuel receiving opening 38, through the opening and into the cylindrical housing 52, the rotating auger engages the biomass fuel and pushes the fuel through the housing at the selected rate away from the proximal end 58 of the auger to the distal end 60 of the auger.

The feed auger assembly 50 is operatively connected to the fireplace portion so as to feed the fuel as the selected rate into the fireplace portion for combustion. The fireplace portion of the illustrated embodiment has a firebox 70 defined by a plurality of sidewalls 72, top and bottom walls 74 and 76, and an openable fireplace door 78. The fireplace door 78 is movable between an open position, which provides access into the front of the firebox 70, and a closed position that sealably closes the front of the fire box. In the illustrated embodiment, the fireplace assembly 10 is a direct vent fireplace assembly, although other embodiments can include other configurations.

In the illustrated embodiment, the feed auger assembly 50 is sealably connected to the rear wall 80 of the firebox 70 around a firebox fuel aperture 82. The firebox fuel aperture 82 is in direct communication with the distal end 60 of the feed auger 54, such that feed auger 54 carries the biomass fuel through the cylindrical housing 52 and pushes the fuel out the distal end 60, through the firebox fuel aperture 82, and into the firebox 70. It is noted that the cylindrical housing 52 and the auger are in direct communication with the firebox 70 and fire that may be burning in the firebox 70. The construction and arrangement of the fuel metering assembly 28 discussed above, however, is such that there is no direct path between firebox 70 and the hopper 14 because of the offset between the fuel receiving opening 38 and the hopper outlet 18 with the blade seal 26 between them. Even if some of the fuel inadvertently begins to burn in the feed auger assembly 50 adjacent to the fuel metering assembly 28, the fuel metering assembly's base structure 36, the metering disc 40 and the blade seal 26 completely block any fire from ever getting to the hopper-side of the fuel metering assembly 28. Accordingly, fire can not get to the hopper 14 from the firebox 70.

The firebox 70 contains a burn platform 84 mounted to the rear wall 80 adjacent to the firebox fuel aperture 82 and positioned to receive the biomass fuel from the feed auger assembly 50. The burn platform 84 is configured so that the feed auger assembly 50 can push the fuel through the firebox feed aperture and onto a rear portion 86 of a support plate 88 of the burn platform 84. As the auger feed system continues to turn and push more fuel onto the support plate 88, the new fuel moving onto the rear portion 86 of the support plate 88 pushes the fuel that was already on the plate forwardly toward a forward portion 90 of the support plate 88. For purposes of explanation, if there was no fire burning in the fire box and the fuel metering assembly 28 and feed auger assembly 50 were allowed to deliver fuel, the fuel on the support plate 88 would continue to be pushed via the entering fuel until the forward-most fuel on the plate would be pushed off a forward edge 92 of a forward portion 90 of the support plate 88 and drop into the ash pan 94. It is noted that the control system 48 is configured so the fuel metering assembly 28 and the feed auger assembly 50 would not continue to operate when there is not a fire burning or being started in the firebox 70.

The burn platform 84 includes an igniter 96 positioned adjacent to the rear portion 86 of the support plate 88. The igniter 96 is configured to ignite the biomass fuel on the rear portion 86 of the support plate 88 to start the fire in the firebox 70. Once the fire has been started, the new fuel entering the firebox 70 through the firebox fuel aperture 82 will be pushed into communication with burning fuel on the support plate 88. In the illustrated embodiment, the rear portion 86 of the support plate 88 is arranged in an upward sloping angle (as the support plate 88 moves forwardly away from the rear wall 80 of the fire box). This upwardly sloped rear portion 86 of the support plate 88 causes, via gravity, the biomass fuel to stay bunched up on the rear portion 86 of the support plate 88 while some of the fuel is burning and as new fuel is being pushed onto the rear portion 86 of the support plate 88. This bunching of the fuel help ignite the new fuel and it help the burning fuel to continue burning to be fully engulfed in flames.

The support plate 88 transitions from the sloped rear portion 86 to a substantially horizontal forward portion 90. As the entering fuel continues to push the burning fuel forwardly up the sloped rear portion 86 of the support plate 88, the burning fuel will be pushed on to the support plate's horizontal front portion, where the burning fuel can spread out a bit to make a wider burning bed of fuel. The feed rate and burn rate of the fuel can be configured such that, by the time the fuel on the support plate 88 would be pushed off the front edges of the plate, the fuel will have fully burned (i.e., be fully consumed) and transitioned into ash. Accordingly, the entering fuel and the burning fuel will eventually push the consumed fuel as ash off the front edge of the support plate 88. This ash will drop into the ash pan 94 in the bottom of the firebox 70.

In the illustrated embodiment, the support plate 88 has a plurality of holes 98 in the front and rear portions that allow combustion air to flow through the support plate 88 over and around the fuel to help burning of the fuel. The holes 98 are also sized so that the unburned biomass fuel will not fall through the holes 98 into the ash pan 94. The holes 98, however, are sized so that the ash from the consumed fuel can fall through holes 98 into the ash pan 94, thereby avoiding an undesirable build up of ash along the front edge portion of the support plate 88.

In the illustrated embodiment, the fireplace assembly 10 has a deflector 100 removably mounted in the fire box so as to surround the front and sides of the support plate 88. The deflector 100 in the illustrated embodiment has a pair of hooks 102 or other engagement members adjacent to the rear portion of the deflector 100, and the hooks 102 connect to a pair of mounting pins 104 or other mounting structure coupled to the firebox's rear wall 80. In other embodiments, the deflector 100 can be mounted directly to the support plate 88 or other structure that holds the deflector 100 adjacent to the support plate 88. One aspect of the deflector 100 provides a structure that forms a visual block so that a person looking through the door 78 into the firebox 70 can not see the actual burning pieces of fuel. The deflector 100, however, is sized so that the flames from the burning fuel extend upwardly past the top edge of the deflector 100, so the person would be able to clearly see the flames from the burning fuel, just not the fuel itself. Accordingly, the deflector 100 acts as a visual deflector.

The deflector 100 of the illustrated embodiment has a top edge portion 110 that slopes rearwardly toward the firebox's rear wall 80. This rearwardly sloped top edge portion 110 is configured so combustion air passing through the front portion of the support plate 88 will be slightly deflected rearwardly over the burning fuel. The sloped top edge portion 110 is also configured to deflect some of the flames near the front of the support plate 88, thereby causing the flames to spread out and to flicker/dance more, so as to simulate flames in a conventional wood burning fire. In the illustrated embodiment, the front side of the deflector 100 includes a decorative configuration that provides a very appealing decorative appearance to the user looking into the firebox 70 through the door 78.

The fireplace assembly 10 of the illustrated embodiment has a plurality of safety sensors 112 coupled to the control system 48. The sensors 112 and the control system 48 are configured to turn off or otherwise temporarily disable the fuel metering assembly 28 and/or the feed auger assembly 50 upon selected events, occurrences, or conditions. For example, the fireplace assembly 10 can includes a pressure sensor coupled to the control system 48, such that pressure in the fireplace assembly 10, such as in the firebox 70, deviates from a selected pressure level or range, the fuel metering assembly 28 can be turn off so fuel delivery to the firebox 70 will stop. The fireplace assembly 10 can include a hopper sensor coupled to the hopper 14 and the control system 48, such that when the hopper 14 is open otherwise not in its fully closed position, the fuel metering assembly 28 is turned off so fuel delivery to the firebox 70 will stop. Other sensors 112, including proximity sensors, temperature-based sensors, and other sensors can be used to help control operation of the fireplace assembly 10.

The control system 48 of at least one embodiment provides a plurality of operation configurations or programs that operatively control the fuel metering assembly 28 and/or the feed auger assembly 50, such as to control the feed rate of the fuel from the hopper 14 into the burner area. For example, the control system 48 can have different operation programs based upon the type of biomass fuel to be burned in the fireplace assembly 10. One program can be for wood pellets so as to provide the appropriate feed rate and burn rate for wood pellets. Another program can be for wood chips, another program can be for corn-based fuel, and another program can be for fruit pits, such as peach or nectarine pits. Other programs can be used for other selected solid fuels (including biomass or non-biomass fuels). The control system 48 can also have programs based upon the desired burn rate and the BTU output for the fireplace assembly 10. The control system 48 can have programs that are based upon a combination of the types of fuel and the desired BTU output. Yet other programs can be provided that are based upon selected time durations for operation of the fireplace assembly 10. Other embodiments can have control systems with other operation programs for a desired type of operation of the fireplace assembly 10.

From the foregoing, it will be appreciated that specific embodiments of the invention have been described herein for purposes of illustration, but that various modifications may be made without deviating from the invention. Additionally, aspects of the invention described in the context of particular embodiments or examples may be combined or eliminated in other embodiments. Although advantages associated with certain embodiments of the invention have been described in the context of those embodiments, other embodiments may also exhibit such advantages. Additionally, not all embodiments need necessarily exhibit such advantages to fall within the scope of the invention. Accordingly, the invention is not limited except as by the appended claims.

We claim:

1. A biomass-burning fireplace assembly, comprising:

a firebox having a fuel inlet opening;

a hopper configured to contain a biomass fuel, the hopper having a hopper outlet with an outlet aperture through which the biomass fuel passes out of the hopper;

a guide connected to the hopper outlet and surrounding the outlet aperture, wherein the guide has a cylindrical bottom portion with a circular cross-section and the outlet aperture is positioned above approximately one-half of the circular cross-section;

a vertically oriented, planar barrier member extending across the circular cross-section of the cylindrical bottom portion adjacent to the outlet aperture, the barrier member extending vertically away from the hopper outlet in a direction normal to the circular cross-section;

a fuel metering assembly adjacent to the hopper outlet, the fuel metering assembly having a first driver, a cylindrical receiving area, and a meter adjacent to the cylindrical receiving area, the meter being coupled to the first driver, the fuel metering receptacle configured to receive the biomass fuel from the hopper, the fuel metering assembly being positioned with the cylindrical bottom portion of the guide extending into the cylindrical receiving area in a male/female fit, with the barrier member extending across the fuel meter receptacle, and the first driver being activatable to rotate the meter, the fuel metering receptacle being moveable relative to the hopper outlet between first and second positions, the fuel metering receptacle in the first position is disposed on a first side of the barrier member and arranged to receive the biomass fuel from the hopper outlet, and the fuel metering receptacle in the second position is disposed on a second side of the barrier member and out of alignment with the hopper outlet, the barrier member providing a physical barrier dividing the cylindrical bottom portion approximately in half and physically blocking a potential fire path between the fuel metering receptacle in the second position and the hopper outlet;

a fuel feed assembly having a feed inlet positioned at least partially under the fuel metering assembly and in alignment with the fuel metering receptacle when the fuel metering receptacle is in the second position to receive the biomass fuel from the fuel metering assembly, wherein the feed inlet is fully blocked from the hopper outlet by at least a portion of the barrier member to avoid a fire path to the hopper, the fuel feed assembly having a fuel feed outlet in communication with the fuel inlet opening in the fire box, the fuel feed assembly having a second driver coupled to a fuel advancing member, wherein the fuel advancing member is disposed between the fuel feed inlet and fuel feed outlet and upon activation of the second driver is configured to move the biomass fuel out the fuel feed outlet and through the fuel feed inlet of the firebox;

a burn platform assembly coupled to the firebox and positioned adjacent to the fuel inlet opening, the burn platform having a support surface that receives the biomass fuel received from the fuel feed assembly; and a controller coupled to the first driver of the fuel metering assembly and to the second driver of the fuel feed assembly, the controller being activatable to drive each of the first and second drivers to control fuel feed rate from the hopper and through the fuel metering assembly and fuel feed assembly.

2. The assembly of claim 1 wherein the barrier member and the cylindrical bottom portion of the guide being immediately adjacent to a top surface of the meter.

3. The assembly of claim 2 wherein the first driver of the fuel metering assembly has a drive motor operatively coupled to the metering disk and configured to rotate the meter below the barrier member.

4. The assembly of claim 1 wherein meter has a second fuel metering receptacle, each of said first and second fuel metering receptacles being moveable between the first and second positions.

5. The assembly of claim 4 wherein the first fuel metering receptacle is in the first position when the second fuel metering receptacle is in the second position.

6. The assembly of claim 1 wherein the barrier member engages the meter when the meter moves the fuel metering receptacle between the first and second positions.

7. The assembly of claim 1 wherein the barrier member is a blade seal that engages the fuel metering assembly.

8. The assembly of claim 1 wherein the fuel feed assembly has a housing, and the fuel advancing member is an auger member rotatably disposed in the housing, wherein rotation of the auger member advances the biomass fuel from the fuel feed inlet to the fuel feed outlet.

9. The assembly of claim 1 wherein the burn platform assembly has a support plate with a first portion adjacent to the fuel inlet opening, a horizontal second portion spaced apart from the fuel inlet opening, and a sloped intermediate portion between first and second portions, wherein the first portion and the sloped intermediate portion are positioned to receive fuel moved by the fuel advancing member through the fuel inlet opening, and wherein the horizontal second portion is configured to receive fuel pushed up the sloped intermediate portion by fuel advancing through the fuel feed outlet and pushed over the first portion, the support plate having a plurality of apertures therein sized to block unburned fuel from falling therethrough but allowing ash from burned furl to fall therethrough.

10. The assembly of claim 1 wherein the burn platform assembly has a deflector member positioned adjacent to the support surface.

11. The assembly of claim 1 wherein the burn platform assembly comprises an ignition member.

12. A fireplace assembly, comprising:

a housing;

a firebox disposed in the housing and having a fuel inlet opening;

a fuel hopper configured to contain a solid fuel, the hopper having a hopper outlet with an outlet aperture;

a guide connected at a top portion to the hopper and having a bottom portion extending away from the hopper outlet, the guide surrounding the outlet aperture with the outlet aperture positioned above approximately one-half of the bottom portion;

a vertically oriented, planar barrier member extending downwardly away from the hopper outlet in a direction normal to a cross-section of the guide's bottom portion, the barrier member extending across the guide adjacent to the outlet aperture;

a fuel metering assembly adjacent to the hopper outlet, the fuel metering assembly having housing with an opening into which the bottom portion of the guide extends in a male/female mating concentric arrangement, the fuel metering assembly having a meter at the bottom of the a fuel metering receptacle spaced apart from the hopper outlet with the guide and barrier member extending between the fuel meting receptacle and the hopper outlet, the fuel metering receptacle being configured to receive the solid fuel from the hopper on only one side of the barrier member, the fuel metering receptacle being moveable relative to the hopper outlet between first and second positions, the fuel metering receptacle in the first position is arranged to receive the solid fuel from the hopper outlet, and the fuel metering receptacle in the second position is on a second side of the barrier member opposite the first side and out of alignment with the outlet aperture, the fuel metering receptacle being out of communication with the hopper outlet when in the second position to fully block a potential fire path to the hopper;

a fuel feed assembly having a feed inlet positioned at least partially under the fuel metering assembly and in direct communication with the fuel metering receptacle in the second position, the fuel feed assembly having a fuel feed outlet in communication with the fuel inlet opening in the fire box and having a fuel advancing member configured to move the solid fuel out the fuel feed outlet and through the fuel feed inlet of the firebox; and a burn platform assembly coupled to the firebox and positioned adjacent to the fuel inlet opening, the burn platform having a support surface that receives the solid fuel received from the fuel feed assembly for burning of the solid fuel in the fire box while on the support portion, wherein the support surface has an upwardly sloped rear portion immediately adjacent to the fuel feed outlet and positioned to receive fuel moved by the fuel advancing member, and a substantially horizontal forward portion connected to an upper edge of the sloped rear portion, wherein the horizontal forward portion is configured to receive fuel pushed up the sloped rear portion by fuel advancing through the fuel feed outlet, the rear and forward portions having a plurality of apertures therein sized to block unburned fuel from falling therethrough but allowing ash from burned furl to fall therethrough.

13. The assembly of claim 12 wherein the fuel metering receptacle is a first fuel metering receptacle, and the meter has a second fuel metering receptacle, each of said first and second fuel metering receptacles being moveable between the first and second positions.

14. The assembly of claim 13 wherein the first fuel metering receptacle is in the first position when the second fuel metering receptacle is in the second position.

15. The assembly of claim 12 wherein the meter is movable relative to the hopper outlet to move the fuel metering receptacle between the first and second position.

16. The assembly of claim 15 wherein the fuel metering assembly includes a driver coupled to the meter and configured to move the meter relative to the hopper outlet.

17. The assembly of claim 12 wherein the barrier member is a blade seal extending laterally across the guide and vertically between the hopper outlet and the fuel metering receptacle when in the second position to create a fire path barrier therebetween.

18. The assembly of claim 12, wherein the meter is movable relative to the hopper outlet to move the fuel metering receptacle between the first and second position.

19. The assembly of claim 18 wherein the meter rotates about a central axis when the meter moves the fuel metering receptacle between the first and second positions.

20. The assembly of claim 12 wherein the burn platform assembly comprises an ignition member adjacent to the first portion of the support plate.

21. A biomass-burning fireplace assembly, comprising:

a firebox having a fuel inlet opening;

a hopper configured to contain a biomass fuel, the hopper having a hopper inlet and a hopper outlet;

a guide attached to the hopper and positioned around the hopper outlet;

a barrier member attached to the guide adjacent to the hopper outlet;

a fuel metering assembly adjacent to the hopper outlet, the fuel metering assembly having a housing with an opening with the guide and barrier member received in the opening below the hopper outlet and the barrier member extends across the opening, the fuel metering assembly having a moveable fuel metering member with a fuel metering receptacle therein configured to receive the biomass fuel from the hopper, the fuel metering receptacle being moveable relative to the hopper outlet between first and second positions, the fuel metering member having a top surface facing the hopper, the barrier member being in engagement with the top surface of the fuel metering member across a width of the opening, the fuel metering receptacle in the first position is disposed on a first side of the barrier member and arranged to receive the biomass fuel from the hopper outlet, and the fuel metering receptacle in the second position is disposed on a second side of the barrier member and out of alignment with the hopper outlet, the barrier member providing a physical barrier between the fuel metering receptacle and the hopper outlet;

a fuel feed assembly having a feed inlet positioned in alignment with the fuel metering receptacle when the fuel metering receptacle is in the second position to receive the biomass fuel from the fuel metering assembly, wherein the feed inlet is fully blocked from the hopper outlet by at least a portion of the guide and the barrier member to avoid a fire path to the hopper, the fuel feed assembly having a fuel feed outlet in communication with the fuel inlet opening in the firebox and having a fuel advancing member disposed between the fuel feed inlet and fuel feed outlet and configured to move the biomass fuel out of the fuel feed outlet and through the fuel feed inlet of the firebox; and a burn platform assembly coupled to the firebox and positioned adjacent to the fuel inlet opening, the burn platform having a support surface that receives the biomass fuel received from the fuel feed assembly, wherein the support surface has an upwardly sloped rear portion immediately adjacent to the fuel feed outlet and positioned to receive fuel moved by the fuel advancing member, and a substantially horizontal forward portion connected to an upper edge of the sloped rear portion, wherein the horizontal forward portion is configured to receive fuel pushed up the sloped rear portion by fuel advancing through the fuel feed outlet, the rear and forward portions having a plurality of apertures therein sized to block unburned fuel from falling therethrough but allowing ash from burned furl to fall therethrough.

22. The assembly of claim 1 wherein the guide is a substantially cylindrical guide with a diameter, the outlet aperture has an area is positioned above approximately one-half of the cylindrical guide, and the barrier member extends vertically away from the hopper outlet and across approximately the diameter of the cylindrical guide, wherein the fuel exiting the outlet aperture will pass through the guide on only one side of the barrier member.

23. The assembly of claim 12 wherein the guide is a substantially cylindrical guide with a diameter, the outlet aperture has an area is positioned above approximately one-half of the cylindrical guide, and the barrier member extends vertically away from the hopper outlet and across approximately the diameter of the cylindrical guide, wherein the fuel exiting the outlet aperture will pass through the guide on only one side of the barrier member.

* * * * *